US010869131B2

(12) United States Patent
Weber et al.

(10) Patent No.: US 10,869,131 B2
(45) Date of Patent: Dec. 15, 2020

(54) MAGNET ASSEMBLY FOR A LOUDSPEAKER AND LOUDSPEAKER WITH SUCH A MAGNET ASSEMBLY

(71) Applicant: Harman Becker Automotive Systems, GmbH, Karlsbad-Ittersbach (DE)

(72) Inventors: Guenther Weber, Ihrlerstein (DE); Marc-Olivier Chauveau, La Membrolle sur Choisille (FR); Armin Prommersberger, Karlsbad (DE)

(73) Assignee: Harman Becker Automotive Systems GmbH

( * ) Notice: Subject to any disclaimer, the term of this patent is extended or adjusted under 35 U.S.C. 154(b) by 0 days.

(21) Appl. No.: 16/313,000

(22) PCT Filed: Jun. 21, 2017

(86) PCT No.: PCT/EP2017/065226
§ 371 (c)(1),
(2) Date: Dec. 21, 2018

(87) PCT Pub. No.: WO2017/220649
PCT Pub. Date: Dec. 28, 2017

(65) Prior Publication Data

US 2019/0246210 A1 Aug. 8, 2019

(30) Foreign Application Priority Data

Jun. 23, 2016 (EP) ..... 16175944

(51) Int. Cl.
*H04R 1/20* (2006.01)
*H04R 9/02* (2006.01)
(Continued)

(52) U.S. Cl.
CPC ..... *H04R 9/025* (2013.01); *H04R 7/02* (2013.01); *H04R 9/06* (2013.01); *H04R 2209/022* (2013.01); *H04R 2209/026* (2013.01)

(58) Field of Classification Search
CPC combination set(s) only.
See application file for complete search history.

(56) References Cited

U.S. PATENT DOCUMENTS 5,148,492 A * 9/1992 Uzawa ..... H04R 1/222 181/166
5,390,257 A * 2/1995 Oslac ..... H04R 9/025 381/414

(Continued)

*Primary Examiner* — Amir H Etesam
(74) *Attorney, Agent, or Firm* — Angela M. Brunetti

(57) ABSTRACT

An example magnet assembly for a loudspeaker includes a first permanent magnet with a cuboid shape, the first magnet encompassing a central opening, and a second permanent magnet with a cuboid shape, the second magnet positioned coaxially within the opening of the first magnet and forming a rectangular-ring shaped first gap therebetween, the first and second magnets being axially poled in opposed directions. The assembly further includes a soft-magnetic base plate connected across one side of the first and second magnets, a soft-magnetic first pole piece having a first face and positioned on the first magnet, and a soft-magnetic second pole piece having a second face and positioned on the second magnet. The first pole piece and the second pole piece form a rectangular-ring shaped second gap between the first and second faces such that magnetic flux is focused in the second gap.

9 Claims, 2 Drawing Sheets

(51) Int. Cl.
*H04R 7/02* (2006.01)
*H04R 9/06* (2006.01)

(56) References Cited

U.S. PATENT DOCUMENTS

| | | | | |
|---|---|---|---|---|
| 9,758,857 | B2 * | 9/2017 | Nagamine | C23C 14/35 |
| 2002/0090106 | A1 * | 7/2002 | Guenther | H04R 9/02 381/412 |
| 2003/0081808 | A1 * | 5/2003 | Kemmerer | H04R 9/022 381/397 |
| 2014/0056447 | A1 * | 2/2014 | Li | H04R 1/00 381/162 |

* cited by examiner

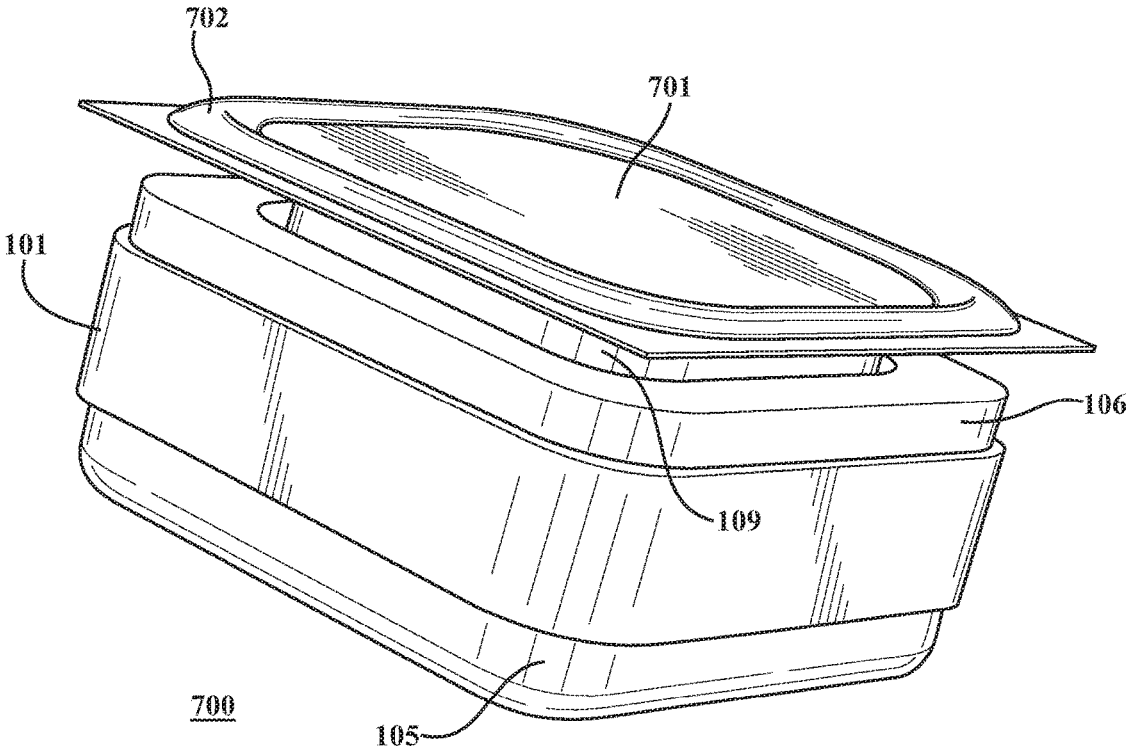
FIG. 7
FIG. 8
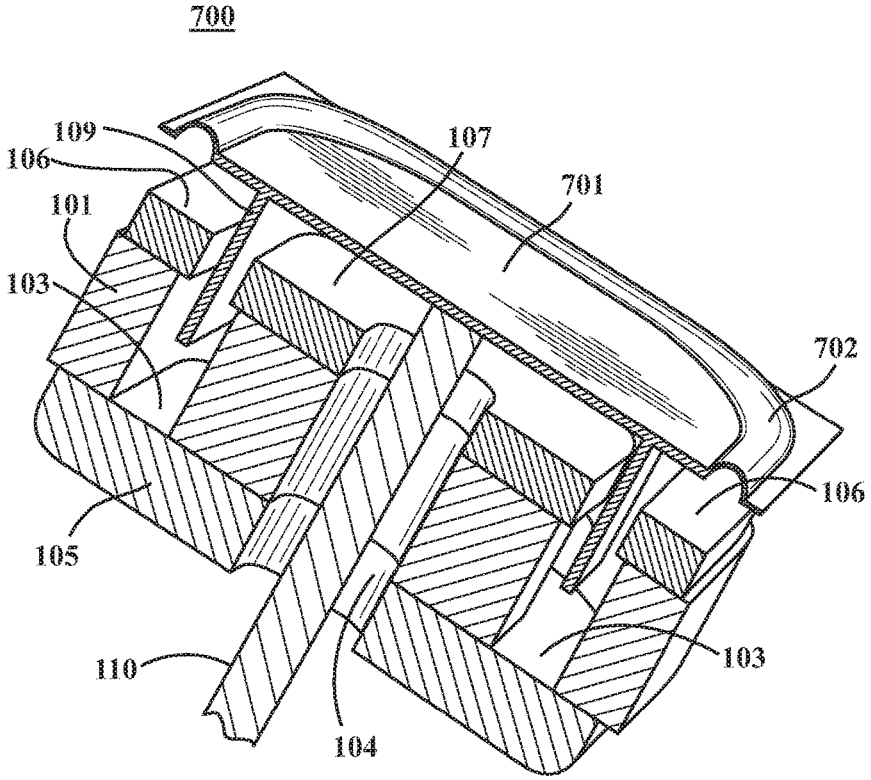

MAGNET ASSEMBLY FOR A LOUDSPEAKER AND LOUDSPEAKER WITH SUCH A MAGNET ASSEMBLY

BACKGROUND

1. Technical Field

The disclosure relates to a magnet assembly for a loudspeaker and loudspeaker with such a magnet assembly.

2. Related Art

In recent years, the number of applications in which compact loudspeakers are employed has grown substantially. This growth is partly due to the arrival of numerous new forms of consumer electronics and personal electronic music playing devices, many of which require or promote the use of accessory loudspeakers for full volume delivery of high quality sound. The increased use of compact loudspeakers has also been fueled by a general trend toward smaller bookshelf or desktop systems, rather than the cabinet work and larger speaker enclosures that had formed the benchmark for audio performance over many decades. Another field are automotive applications where only limited space is available. For many of these applications, light weight and small size on the one hand and an optimized performance of such a loudspeaker on the other are important. In such cases, the design of the magnet assembly and the diaphragm play an important role. However, the trend to small loudspeakers poses numerous technical drawbacks, especially in terms of efficiency. Thus, it would be desirable to provide an improved magnet assembly and, thus, an improved loudspeaker.

SUMMARY

An example magnet assembly for a loudspeaker includes a first permanent magnet with a cuboid shape, the first magnet encompassing a central opening, and a second permanent magnet with a cuboid shape, the second magnet positioned coaxially within the opening of the first magnet and forming a rectangular-ring shaped first gap therebetween, the first and second magnets being axially poled in opposed directions. The assembly further includes a soft-magnetic base plate connected across one side of the first and second magnets, a soft-magnetic first pole piece having a first face and positioned on the first magnet, and a soft-magnetic second pole piece having a second face and positioned on the second magnet. The first pole piece and the second pole piece form a rectangular-ring shaped second gap between the first and second faces such that magnetic flux is focused in the second gap.

An example loudspeaker includes a diaphragm, a voice coil connected to the diaphragm, and a magnet assembly defining a flux gap, wherein the voice coil is positioned in the flux gap. The magnet assembly includes a first permanent magnet with a cuboid shape, the first magnet encompassing a central opening, and a second permanent magnet with a cuboid shape, the second magnet positioned coaxially within the opening of the first magnet and forming a rectangular-ring shaped first gap therebetween, the first and second magnets being axially poled in opposed directions. The magnet assembly further includes a soft-magnetic base plate connected across one side of the first and second magnets, a soft-magnetic first pole piece having a first face and positioned on the first magnet, and a soft-magnetic second pole piece having a second face and positioned on the second magnet. The first pole piece and the second pole piece form a rectangular-ring shaped second gap between the first and second faces such that magnetic flux is focused in the second gap.

Other assemblies, loudspeakers, methods, features and advantages will be, or will become, apparent to one with skill in the art upon examination of the following detailed description and appended figures. It is intended that all such additional assemblies, loudspeakers, features and advantages be included within this description, be within the scope of the invention, and be protected by the following claims.

BRIEF DESCRIPTION OF THE DRAWINGS

The assemblies and loudspeakers may be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIG. 7 is a perspective view illustrating an exemplary loudspeaker with the magnet assembly shown in FIGS. 1 to 6.

FIG. 8 is a perspective sectional view of the loudspeaker shown in FIG. 7.

DETAILED DESCRIPTION

Figure 2:
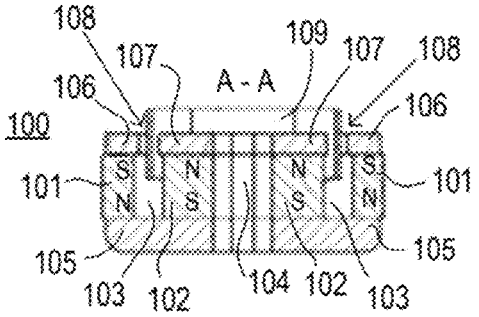
FIG. 2 is a sectional view of the magnetic assembly shown in FIG. 1.
Figure 1:
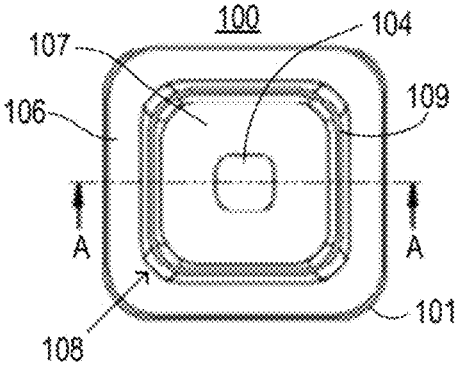
FIG. 1 is a top view of an exemplary magnetic assembly with a cuboid outer permanent magnet and a concentrically disposed cuboid inner magnet.
Figure 3:
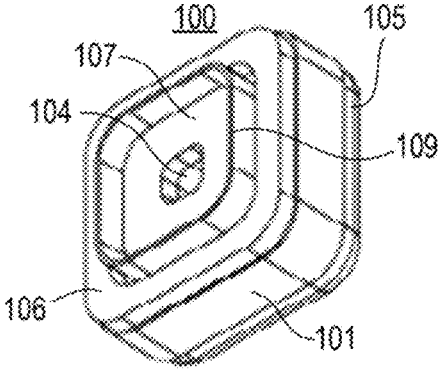
FIG. 3 is perspective view of the magnetic assembly shown in FIGS. 1 and 2.

FIG. 1 is a top view of an exemplary magnetic assembly 100 for a loudspeaker. FIG. 2 illustrates the magnetic assembly 100 showing a section taken along a radial plane A-A, indicated in FIG. 1 by a doted line through the center of the magnet assembly 100. FIG. 3 is three-dimensional view of the magnetic assembly 100.

Referring to FIGS. 1 to 3, the magnetic assembly 100 includes a first cuboid permanent magnet 101 and a smaller second cuboid permanent magnet 102 that each have a central opening 103, 104, i.e., are shaped like rectangular rings with different diameters, and that are positioned coaxially to each other with magnet 101 as outer magnet and magnet 102 as inner magnet to form a gap between the two magnets 101, 102. Magnets 101, 102 are axially poled in opposed directions (N-S and S-N) and are magnetically connected together by a magnetic shunt member such as a soft-magnetic base plate 105 on one side (herein also referred to as bottom side) of the magnets 101, 102. Optionally, the shunt member, rather than being a flat plate or sheet, may be a shaped member, e.g., thinning toward its radially inner and radially outer edges. On the other side of the magnets 101, 102 respective shaped pole pieces 106, 107 are disposed and attached thereto.

As shown in FIGS. 1 to 3, the outer and inner magnets 101, 102 are positioned concentrically, with a small space between the outer periphery of the inner magnet 102 and the inner wall of the outer magnet 101. The pole pieces 106, 107 each are or include a rectangular ring, and each sits on the other side (herein also referred to as the top side) of the respective magnet 101, 102 such that the separation between opposing faces of the two pole pieces forms a voice coil gap 108. In the illustrated exemplary magnet structure, voice coil gap 108 has a smaller gapwidth than the gap between the two magnets 101, 102 in the underlying space. The pole pieces 106, 107 are concentric with each other and the two magnets 101, 102, and may be thicker proximate to the voice coil gap 108, e.g., may be tapered or thinned nearer to the radial inner and outer edges, respectively, of the assembly 100. The voice coil gap 108 is designed to accommodate a cylindrical voice coil 109. In the examples shown, the cuboid shape of the magnets may have a basic form with an aspect ratio of 1:1, which is a square basic form, but may be any other suitable ratio. Some or all edges of at least one of the magnets 101, 102 may be radiused to achieve more homogenous magnetic fields and/or to avoid mechanical damage to the edges. The base plate 105 may have an opening as well as the pole piece 107 so that the opening 104 also extends through the base plate 105 and the pole piece 107.

The outer pole piece, which is in the present case pole piece 106, may include a projecting peripheral stand (not shown) or any other suitable means to support an edge of a diaphragm (e.g., a flat diaphragm as described below in connection with FIGS. 7 and 8). The pole pieces 106, 107 are formed of a suitable soft-magnetic material, e.g., iron or steel, and their shape serves to better utilize the magnetic flux, concentrating it in the voice coil gap 108, as well as to provide relief or clearance so that the voice coil 109 and/or the diaphragm does/do not buzz. The magnets 101, 102 are made from suitable permanent magnetic material such as, e.g., rare earth or neodymium based materials. The rectangular base form provides a better exploitation of the room, which means, with the same room available, a higher magnetic flux and, thus, a higher sound pressure level can be achieved as with magnets having a circular base form.

Figure 4:
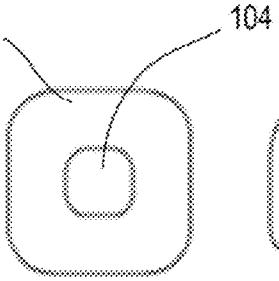
FIG. 4 is a top view of the inner magnet of the magnetic assembly shown in FIGS. 1 to 3.
Figure 6:
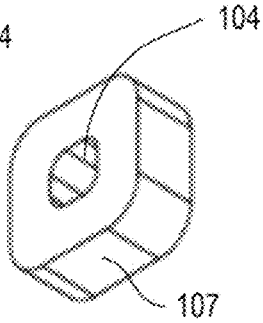
FIG. 6 is a perspective view of the inner magnetic shown in FIGS. 4 and 5.
Figure 5:
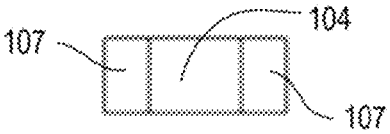
FIG. 5 is a sectional view of the inner magnetic shown in FIG. 4.

The inner magnet 102 is shown in more detail in FIGS. 4 to 6, in which FIG. 4 is a top view of the inner magnet 102, FIG. 5 is a sectional view of the inner magnet 102, and FIG. 6 is a perspective view of the inner magnet 102. As can be seen, the inner magnet 102 may have the circumferential inner and outer edges radiused, e.g., corresponding to radiused circumferential inner and outer edges of the outer magnet 101. The opening 104 of the inner magnet 102 may have a square-shaped profile, i.e., cross-sectional contour, (with radiused, e.g., round edges) but may have any other suitable shape such as circular, oval, rectangular shape with any suitable aspect ratio, or combinations thereof. The opening 104 when forming a through-hole allows for venting the diaphragm from the rear side (the side facing the magnet assembly). Furthermore, power leads 110 for the voice coil may be passed through the opening 104 (see FIG. 8).

FIGS. 7 and 8 illustrate an exemplary loudspeaker 700 with the magnet assembly 100, the voice coil 109 and a rectangular, e.g., square diaphragm 701 schematically. FIG. 7 is a perspective view and FIG. 8 is a perspective sectional view of the loudspeaker 700. The voice coil 109 which may, for example, include a copper or other conductive winding with an electrically insulating layer on a cylindrical bobbin (formed, e.g., of a Kapton sheet), resides movably in the voice coil gap 108 where the magnet assembly 100 concentrates the magnetic flux. The diaphragm 701 is shown as a flat sheet extending across and beyond the region spanned by the cylindrical voice coil 109. Such a diaphragm 701 may be suspended about its outer periphery by a flexible rubber or polymer band 702 attaching it to the peripheral stand (not shown) of the outer pole piece 106 or a frame (not shown). Alternatively, the diaphragm may be a domed or concave diaphragm spanning the coil diameter, or may be a sheet or cone positioned such that it extends primarily around the outside of the periphery of the voice coil to mount in a much larger frame. In this case, an additional annular band of flexible but dimensionally stable material typically attaches to the voice coil or to the diaphragm in the region of the voice coil to keep it in the center of the voice coil gap 108. At the outer peripheral edge of the cone, another flexible band typically attaches the diaphragm to a loudspeaker frame.

The description of embodiments has been presented for purposes of illustration and description. Suitable modifications and variations to the embodiments may be performed in light of the above description. The described assemblies and loudspeakers are exemplary in nature, and may include additional elements and/or omit elements. As used in this application, an element recited in the singular and proceeded with the word "a" or "an" should be understood as not excluding plural of said elements, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these assemblies and loudspeakers have been disclosed in the context of certain embodiments and examples, it will be understood that these assemblies and loudspeakers may be extended beyond the specifically disclosed embodiments to other embodiments and/or uses and obvious modifications thereof.

The invention claimed is:

1. A magnet assembly for a loudspeaker, the assembly comprising:

a first permanent magnet with a cuboid shape, the first permanent magnet encompassing a central opening;

a second permanent magnet with a cuboid shape, the second permanent magnet positioned coaxially within the opening of the first permanent magnet and forming a rectangular-ring shaped first gap therebetween, the first and second permanent magnets being axially poled in opposed directions, the second permanent magnet has venting opening;

a soft-magnetic base plate connected across one side of the first and second permanent magnets, the soft-magnetic base plate has a venting opening corresponding to the venting opening of the second permanent magnet;

a soft-magnetic first pole piece having a first face, the first pole piece being positioned on the first permanent magnet;

a soft-magnetic second pole piece having a second face, the second pole piece being positioned on the second permanent magnet, wherein the first pole piece and the second pole piece form a rectangular-ring shaped second gap between the first and second faces such that magnetic flux is focused in the second gap, the second gap receives a voice coil of the loudspeaker; and power leads pass through the venting opening in the soft-magnetic base plate and the corresponding venting opening of the second permanent magnet connecting to the voice coil.

2. The magnet assembly of claim 1, wherein the venting opening has a rectangular, square, circular or oval cross-sectional contour.

3. The magnet assembly of claim 1, wherein the venting opening is arranged centrally in the second permanent magnet.

4. The magnet assembly of claim 1, wherein at least one of the first permanent magnet and second permanent magnet is a rare earth magnet.

5. The magnet assembly of claim 1, wherein at least one of the first permanent magnet and second permanent magnet is a neodymium magnet.

6. The magnet assembly of claim 1, wherein at least some edges of at least one of the first permanent magnet and second permanent magnet are radiused.

7. The magnet assembly of claim 1, wherein the first gap and the second gap each have a width, the width of the second gap being smaller than the width of the first gap.

8. The magnet assembly of claim 1, wherein the first permanent magnet and the second permanent magnet have a square base form.

9. The magnet assembly of claim 1, wherein the second gap has a square-ring shape.

* * * * *